United States Patent [19]

Anderson

[11] 4,344,053

[45] Aug. 10, 1982

[54] MODE SUPPRESSOR FOR CIRCULAR WAVEGUIDES UTILIZING A PLURALITY OF RESISTANCE CARDS

[75] Inventor: Tore N. Anderson, Brookfield, Conn.

[73] Assignee: Litton Systems, Inc., Morris Plains, N.J.

[21] Appl. No.: 234,067

[22] Filed: Feb. 12, 1981

[51] Int. Cl.[3] ..... H01P 1/162

[52] U.S. Cl. ..... 333/251; 333/34

[58] Field of Search ..... 333/251

[56] References Cited

U.S. PATENT DOCUMENTS

| | | | |
|---|---|---|---|
| 2,981,906 | 4/1961 | Turner | 333/251 X |
| 3,184,695 | 5/1965 | Unger | 333/251 |
| 3,251,011 | 5/1966 | Unger | 333/251 |

*Primary Examiner*—Paul L. Gensler

*Attorney, Agent, or Firm*—Michael H. Wallach; Robert F. Rotella

[57] ABSTRACT

A mode suppressor for use with circular waveguides which are over-sized to provide a low-loss transmission path for signals in the $TE_{11}$ mode and which carry an electric field which is perpendicular to the longitudinal axis of the waveguide. The mode suppressor includes resistance cards located in planes which are generally parallel to the longitudinal axis of the circular waveguide and generally perpendicular to the electric field of the $TE_{11}$ mode. Resistance cards are also contained in secondary waveguides which are coupled to the sidewalls of the circular waveguide. The resistance cards in the secondary waveguide lie in a plane parallel to the $TE_{11}$ electric field and perpendicular to the longitudinal axis of the circular waveguide. The TM and $TE_{on}$ modes (where n is an integer of 1 or greater) are suppressed by the resistance cards lying parallel to the longitudinal axis. The $TE_{21}$ and $TE_{31}$ modes are suppressed by the resistance cards contained in the secondary waveguides.

7 Claims, 5 Drawing Figures

MODE SUPPRESSOR FOR CIRCULAR WAVEGUIDES UTILIZING A PLURALITY OF RESISTANCE CARDS

BACKGROUND OF THE INVENTION

1. Field of the Invention

This invention relates to circular waveguides in general and more particularly to circular waveguides which are over-sized to provide a low-loss transmission path for microwave signals in the dominant $TE_{11}$ mode.

2. Description of the Prior Art

It is known in the prior art to use over-sized circular waveguides to provide a low-loss transmission path for microwave signals in the dominant $TE_{11}$ mode. For any mode of transmission of a microwave signal in a circular waveguide, the electric and magnetic transverse fields may each be resolved into a respective set of tangential and radial components. Those skilled in the art of microwave theory are aware that both the tangential and radial components vary periodically in amplitude along a circular path which is concentric with the wall of the waveguide, and also vary in amplitude along any given radius in a manner related to a Bessel function of order m. Modes of a transverse electric field are identified by the notation $TE_{mn}$ and modes of a transverse magnetic field are identified by the notation $TM_{mn}$, where m represents the total number of full period variations of either the tangential or radial component of the respective electric or magnetic field along a circular path concentric with the wall of the waveguide, and n represents one more than the total number of reversals of polarity (sign) of either the tangential or the radial component of the respective electric or magnetic field along a radial path.

The dominant mode in circular waveguides is denoted as the $TE_{11}$ mode, which corresponds to the $TE_{10}$ mode in rectangular waveguides. It is well known in the prior art that the larger the cross-sectional area of a circular waveguide, or the higher the operating frequency, the greater will be the number of modes which may be supported within a circular waveguide. It is also known that it is desirable to confine the energy propagated in a circular waveguide to the dominant mode.

Higher-order mode signals may be generated and trapped by the terminations at the ends of an oversized circular waveguide, where the terminations form transitions to rectangular, single-moded waveguides. A radar system provides but one example of a microwave transmission system in which the above-referenced arrangement of circular and rectangular waveguides might be used. Higher-order mode signals which are spuriously generated and trapped between the transitions may be reflected back and forth in the circular waveguide before being dissipated. The reflected signals may produce false radar targets or echoes in the receiving apparatus, which are both undesirable and which degrade the performance of the radar system.

It is well known in the art to use rectangular waveguides which operate in the dominant $TE_{10}$ mode to couple each end of a circular overmoded waveguide to other microwave components. A transition section is employed at each interface between the circular and rectangular waveguide to launch and receive the microwave signal, which is preferably transmitted in the circular waveguide in the $TE_{11}$ mode.

One problem with over-sized circular waveguides operating in the dominant $TE_{11}$ mode which are used in systems containing rectangular waveguides is that the circular waveguides can support a variety of higher-order modes, in addition to the desired $TE_{11}$ mode.

Another problem associated with over-sized circular waveguides used in systems containing rectangular waveguides is that the circular waveguides can propagate higher-order modes which resonate between transitions which connect the circular waveguides to the rectangular waveguides. If the length of the circular waveguide is an integral number of half wavelengths at the chosen operating frequency, the resonance condition will degrade the transmission efficiency of the system by forming an attenuation peak which is produced by the higher-order mode energy trapped in the circular waveguide system being reflected at each end of the circular waveguide by the transition sections joining the circular waveguide to the rectangular waveguide sections.

Known prior art patents of interest which show forms of mode suppressors or absorbers include U.S. Pat. No. 3,218,586 issued Nov. 16, 1965; U.S. Pat. No. 3,016,502 issued Jan. 9, 1962; and U.S. Pat. No. 3,031,661 issued Apr. 24, 1962.

SUMMARY OF THE INVENTION

One object of this invention is to provide a higher-order mode suppressor for circular waveguides operating in the $TE_{11}$ mode which will provide a low loss to microwave energy in the dominant ($TE_{11}$) mode.

Another object is to provide a higher-order mode suppressor for circular waveguides which will provide a high degree of attenuation of higher-order mode TE and TM signals.

Still another object is to provide a higher-order mode suppressor for circular waveguides which may be easily assembled from low-cost, passive components.

The above objects and other advantages are achieved by a mode suppressor comprised of a plurality of resistance cards. A first set of resistance cards are placed within the waveguide in planes generally parallel to the longitudinal axis of the waveguide with the planes in which the cards lie being substantially perpendicular to the $TE_{11}$ electric field to suppress the $TM_{mn}$ and $TE_{on}$ modes where n is an integer having a value from 1 to the highest value which the particular waveguide size or frequency may support. The undesired $TE_{21}$ and $TE_{31}$ modes are absorbed by resistance cards which are contained in secondary waveguides which are cut in the walls of the waveguide and which contain resistance cards which lie in a plane generally perpendicular to the longitudinal axis of the waveguide and parallel to the electric field of the $TE_{11}$ mode.

The attenuation of the dominant $TE_{11}$ mode by the mode suppressors is very slight, while the unwanted higher-order modes of the TE and the TM waves are effectively attenuated. The mode suppressor may either be entirely contained within the circular waveguide or in a transition section between the circular and rectangular waveguide, or its components may be divided between the circular waveguide and transition sections. The mode suppressor may be easily assembled with a minimum number of components.

BRIEF DESCRIPTION OF THE DRAWINGS

The above and other objects of this invention will be evident from an understanding of the preferred embodiment which is set forth in such detail as to enable those skilled in the art to readily understand the function, operation, construction and advantages of it when read in conjunction with the accompanying drawings in which.

DESCRIPTION OF THE PREFERRED EMBODIMENT

Figure 1:
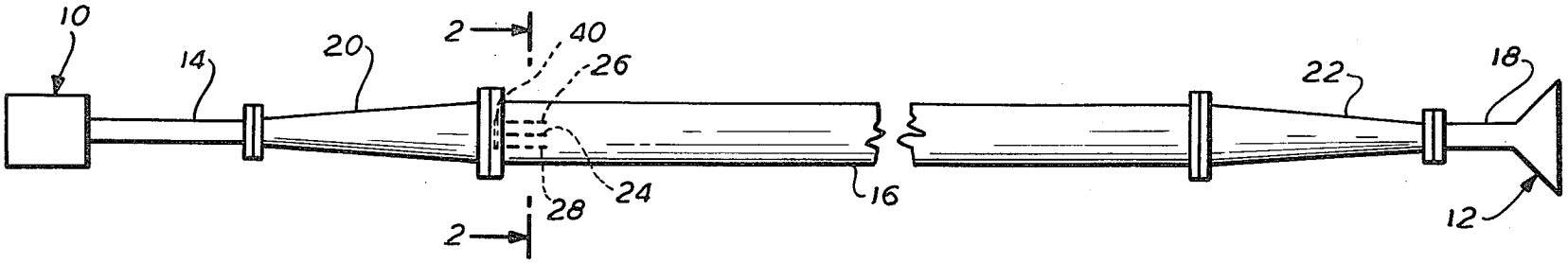
FIG. 1 is a schematic view of a waveguide system to which a preferred embodiment of the invention may be advantageously applied.

Referring to the drawings, FIG. 1 shows a schematic arrangement of waveguides for transmitting microwave energy between a source and a load, as for example between a radar transmitter-receiver 10 and a radar antenna 12. The arrangement of waveguides includes a rectangular waveguide 14 for coupling the transmitter-receiver 10 to an elongated length of circular transmission waveguide 16 and a rectangular waveguide 18 for coupling the circular transmission waveguide 16 to the antenna 12. Preferably the transition from the rectangular waveguide 14 to the circular waveguide 16 is made through a first transition section 20 and the transition from the circular waveguide 16 to the rectangular waveguide 18 is made through a second transition section 22.

Those skilled in the art will readily appreciate that a circular waveguide 16 is preferably used to connect the microwave source, as for example the transmitter-receiver 10, to the load, as for example the antenna 12, because of the substantially lower signal loss exhibited by circular waveguides, as compared to rectangular waveguides operated in the fundamental mode, which permits the efficient separation of the transmitter-receiver 10 from the antenna 12. Other reasons, also obvious to those skilled in the art, include the ease of manufacturing long lengths of circular waveguide to high tolerances, and the ability to pressurize the waveguide to prevent electrical discharges from occurring therein.

The microwave source 10 shown in FIG. 1 is constructed to generate a microwave signal in the rectangular waveguide in the dominant $TE_{10}$ mode for transmission through the rectangular waveguide 14. The $TE_{10}$ mode signal is converted for transmission in the circular waveguide into a signal in the $TE_{11}$ mode in the rectangular to circular transition section 20 in a manner which is well known in the relevant art. After transmission through the circular waveguide 16, the $TE_{11}$ signal is converted in transition section 22 into a signal having a dominant $TE_{10}$ mode for transmission in a rectangular waveguide, and is thereafter applied to the load 12 via the rectangular waveguide 18.

One problem associated with the use of the circular waveguide 16 is that while it will efficiently transmit a $TE_{11}$ signal with little attenuation, it may also support higher-order modes, as for example the $TE_{01}$, $TE_{21}$, $TE_{31}$ and $TE_{41}$ modes of electric waves, and the $TM_{01}$, $TM_{02}$, $TM_{11}$, $TM_{21}$ and $TM_{31}$ modes of magnetic waves. These higher-order modes are particularly troublesome when the length of the circular waveguide 16 is chosen to be an integral number of half wavelengths of the operating frequency of the waveguide, because the higher-order modes are trapped at each end of the circular waveguide by the transition sections 20 and 22 which present a short circuit to the higher-order mode signals. The energy present in the higher-order modes which are trapped by the transitions is reflected between the transition sections 20 and 22, and travels back and forth between the transitions 20 and 22 until it dissipates. The presence of the higher-order mode energy is undesirable since it provides a spurious signal which, in a radar system for example, can be interpreted as a false target or echo, or in a communication transmission system can manifest itself as noise.

Figure 3:
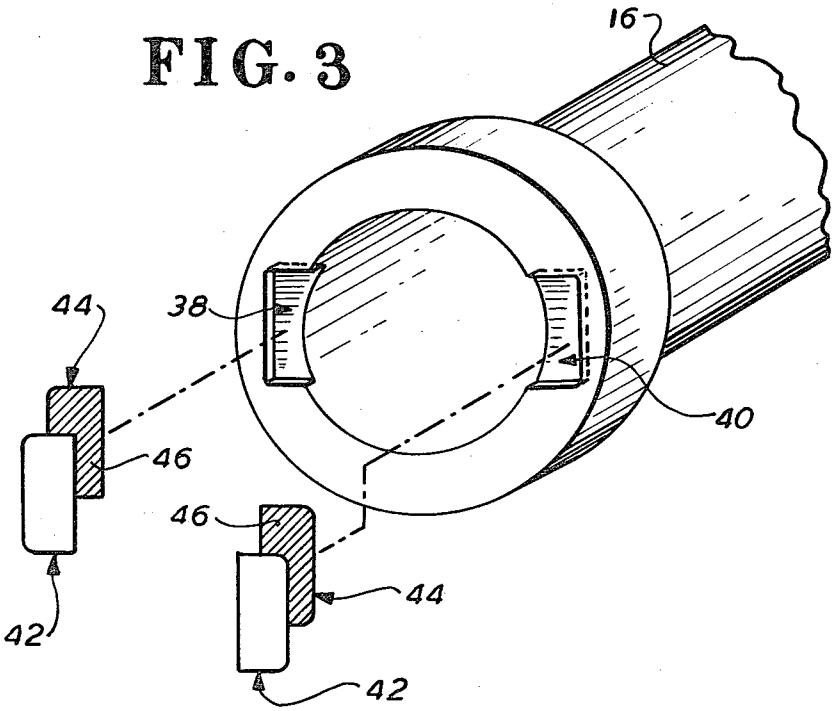
FIG. 3 is a perspective view of a circular waveguide showing the secondary waveguides which suppress the $TE_{21}$ and $TE_{31}$ modes.
Figure 2:
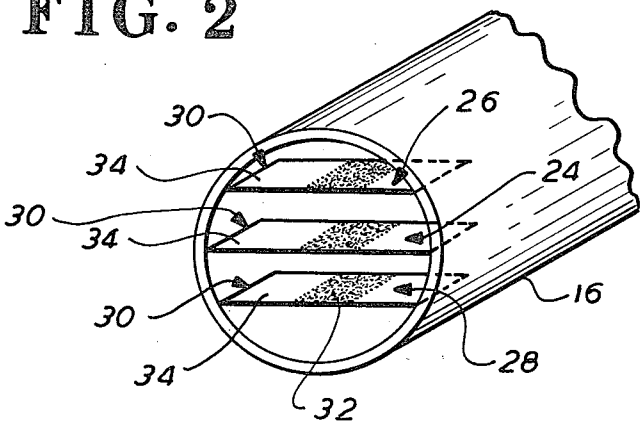
FIG. 2 is a perspective view of one extremity of a circular waveguide containing resistance cards for suppressing the $TM_{mn}$ and $TE_{on}$ modes.

FIGS. 2 and 3 show the elements of a preferred embodiment of a mode suppressor which incorporates the teachings of this invention. The circular waveguide 16 has applied thereto a set of resistance cards with a first resistance card 24 contained in a plane extending generally along the longitudinal axis of the waveguide 16 and a pair of second resistance cards 26 and 28 contained in planes which are generally parallel to the resistance card 24 and which are spaced above and below the card 24. Preferably the resistance cards 24, 26 and 28 are formed from thin sheets of mica 30 and have a resistive film 32 deposited thereon. Preferably the resistive film 32 of the first card 24 has a characteristic resistance of about 50 ohms per square. Preferably the resistive film 32 of the second resistance cards 26 and 28 have a characteristic resistance of about 300 ohms per square. The resistance cards 24, 26 and 28 preferably extend along the longitudinal axis of the waveguide 16 a distance equal to about one half the wavelength of the dominant mode signal to be propagated along the waveguide 16. Each of the cards 24, 26 and 28 have the resistive film 32 in the central portion thereof, with spaces 34 on the outside edges of the surface of the cards 24, 26 and 28 remaining uncoated to prevent absorption and the consequential attenuation of the desired dominant $TE_{11}$ mode signal.

The undesired TM mode signals having electric fields which predominantly lie in the plane of the card 24 are absorbed and dissipated by the resistive film 32 contained on the first resistance card 24. Since the electric field vector of the dominant $TE_{11}$ mode signals were substantially vertical to the plane of the first card 24, the $TE_{11}$ mode signal does not experience significant attenuation and will pass therethrough unaffected.

The $TE_{01}$ and $TE_{on}$ modes, where n may take the value of any integer greater than 1, are absorbed by the second resistance cards, 26 and 28. Preferably the cards 26 and 28 are spaced midway between the wall of the waveguide 16 and its longitudinal axis, which corresponds to the location of the maximum field intensity of the $TE_{01}$ mode. By limiting the resistive material 32 to the central regions of the card 26 and the card 28, the $TE_{01}$ and $TE_{on}$ modes may be absorbed with little attenuation of the $TE_{11}$ mode signal.

In the preferred embodiment, resistance cards 24, 26 and 28 are retained within the circular waveguide by any suitable means, as for example by small grooves machined into the walls of the waveguide.

The unwanted $TE_{mn}$ modes, where m is an integer having a value of 2 or more and n is the integer 1, as for example the $TE_{21}$ and $TE_{31}$ modes, are not absorbed by the resistance cards 24, 26 and 28 because the electric field components thereof are substantially parallel to the desired $TE_{11}$ mode.

Suppression of the undesired $TE_{21}$ and $TE_{31}$ (and higher-order) modes is accomplished by providing a pair of short auxiliary sections of secondary dielectric loaded waveguide 38 and 40 which, as shown in FIG. 3, may be adjacent to the side walls of the waveguide 16, and in a plane perpendicular to the longitudinal axis of the waveguide 16. Preferably each of the secondary waveguides 38 and 40 are parallel to the $TE_{11}$ electric field and contain therein a pair of resistance cards such as the cards 42 and 44 shown in FIG. 3. Preferably the cards 42 and 44 each have a resistive film 46 deposited on one side thereof. One pair of cards 42 and 44 are loaded into each of the secondary waveguides 38 and 40 with the resistive film side 46 of card 42 in electrical contact with the resistive film side 46 of card 44. Preferably the resistivity of the films 46 contained on the card 42 and the card 44 is approximately 50 ohms per square.

Figure 4:
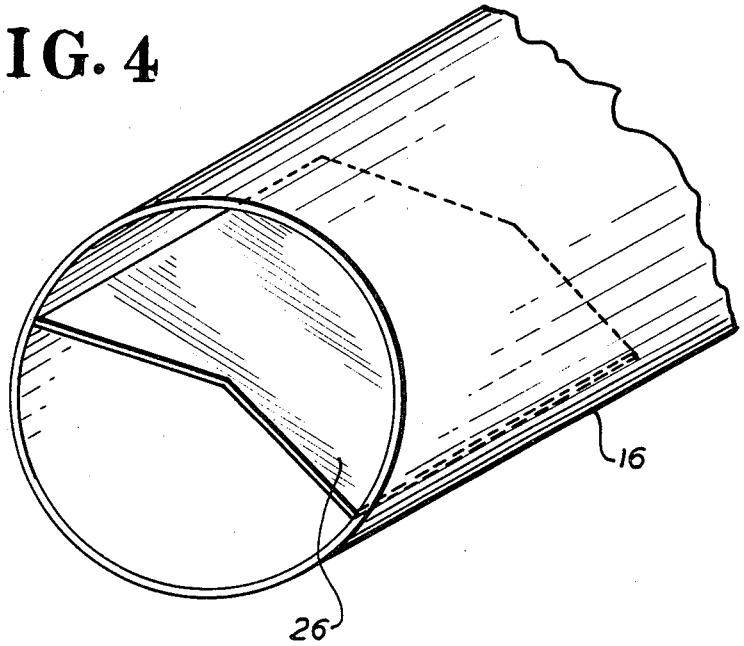
FIG. 4 shows a circular waveguide containing a resistance card having an edge geometry which may be used in high-power applications to avoid unwanted reflections of microwaves.
Figure 5:
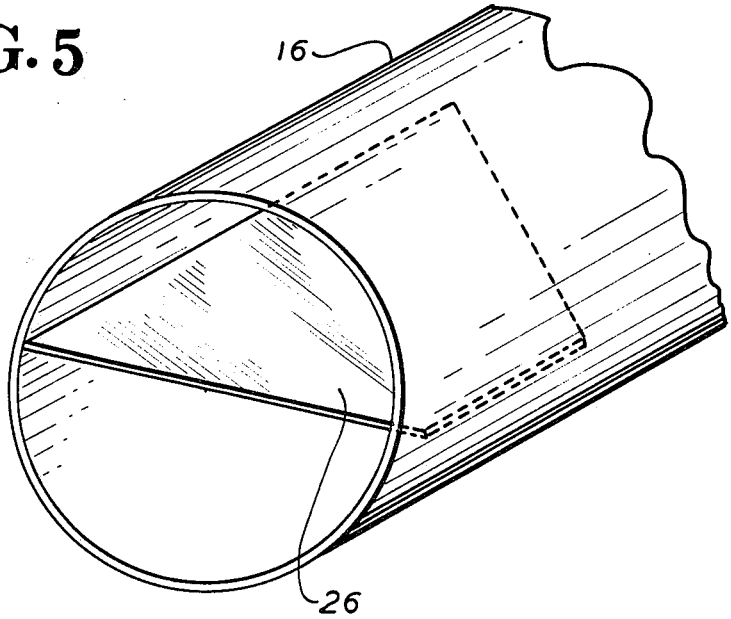
FIG. 5 is a view similar to FIG. 4 showing another edge geometry of a resistance card which may be used in high-power applications.

It will be apparent to those skilled in the art that the cards 24, 26 and 28 may be made from any suitable dielectric material, as for example from mica or a ceramic composition. Preferably the cards 24, 26 and 28 are kept thin so that the reflection of microwaves will not occur from the edges thereof. In systems where the mode suppressor disclosed herein is subject to high power levels, it will be apparent that thicker cards must be used to dissipate heat generated in the resistive film to avoid the possibility of cracking the card as a result of thermal stressing. Reflection of microwave energy from the thicker cards may be avoided by tapering the edges of the cards, as for example the card 26 as shown in FIG. 4 or in FIG. 5.

The higher-order mode suppressor disclosed herein has been shown incorporated within the structure of the circular waveguide 16. However, it is to be understood that suppression of higher-order unwanted modes may also be achieved by integrally locating all components of the mode suppressor within the transition section 20 or 22 or by including it within a unitary circular waveguide element which is connected between the transition sections 20 and 22 and the waveguide 16.

It is also to be understood that more than one higher-order mode suppressor constructed in accordance with the teachings of this invention may be incorporated into a microwave transmission system to achieve any degree of mode suppression desirable.

Moreover, if the higher-order modes of the $TM_{mn}$ and $TE_{on}$ waves are small compared to the dominant $TE_{11}$ wave, only one resistive card such as the card 24 may be placed in a plane displaced slightly from the longitudinal axis of the waveguide to effectively suppress the unwanted, higher-order modes. Obviously, a pair of resistance cards such as the cards 42 and 44 will still be required in the secondary waveguides 38 and 40 to suppress the unwanted $TE_{21}$ and $TE_{31}$ (and higher-order) modes.

It should be apparent that what has been disclosed is a simple and reliable higher-order mode suppressor for circular waveguides, which uses a minimum number of easily assembled parts and which offers flexibility in locating the suppressor in a microwave transmission system. The mode suppressor is also easily adaptable to use with high-power microwave transmission systems by means of selecting an appropriate resistive film and card material and configuration for carrying the film, and by use of a plurality of suppressors within the microwave transmission system. Numerous other alterations to the structure herein disclosed may become apparent to those skilled in the art. However, it is to be understood that the present disclosure relates to a preferred embodiment of the invention which is for the purpose of illustration only and not to be construed as a limitation to the scope of the invention. All modifications which do not depart from the spirit of the invention are intended to be included within the scope of the appended claims.

I claim:

1. A mode suppressor for use in combination with a circular waveguide having a circular sidewall and a longitudinal axis for suppressing unwanted modes of a microwave signal having an electric field perpendicular to the longitudinal axis of said circular waveguide, said mode suppressor comprising:

a first resistance means lying in a plane including the longitudinal axis of said circular waveguide with the plane of said resistance means being substantially perpendicular to the electric field of the $TE_{11}$ mode of said microwave signal, said resistance means having an electrically conducting resistive film for suppressing the TM mode but not the $TE_{11}$ mode of microwave signals;

a pair of second resistance means lying in respective planes above and below the plane of said first resistance means and generally parallel to the plane of said first resistance means, each of said second resistance means having an electrically conducting resistive film on the central portions thereof for suppressing the $TE_{on}$ modes of microwave signals where n is an integer of 1 or more;

a pair of secondary waveguides electrically coupled to said circular waveguide, said secondary waveguides having slots contained in planes perpendicular to the longitudinal axis of said circular waveguide; and third resistance means contained in each of said secondary waveguides, said third resistance means having an electrically conducting resistive film for suppressing microwave signals in at least the $TE_{21}$ and $TE_{31}$ modes.

2. A circular waveguide for carrying a microwave signal in the $TE_{11}$ mode, said circular waveguide having an integral mode suppressor for suppressing unwanted modes of said microwave signal, said circular waveguide having a circular sidewall and a longitudinal axis, with said microwave signal having an electric field perpendicular to the longitudinal axis of said circular waveguide, said integral mode suppressor comprising:

a first resistance means contained within said circular waveguide and lying in a plane including the longitudinal axis of said circular waveguide with said first resistance means contained in a plane substantially perpendicular to the electric field of the $TE_{11}$ mode of said microwave signal, said resistance means having an electrically conducting resistive film for suppressing the TM mode but not the $TE_{11}$ mode of microwave signals;

a pair of second resistance means contained within said circular waveguide and lying in respective planes above and below the plane of said first resistance means and generally parallel to the plane of said first resistance means, each of said second resistance means having an electrically conducting resistive film on the central portion thereof for suppressing the $TE_{on}$ modes of microwave signals where n is an integer having a value of one or more;

a pair of secondary waveguides comprising a pair of slots in the sidewall of said circular waveguide, said secondary waveguides being contained in a plane parallel to the electric field of the microwave signal; and third resistance means contained in each of said secondary waveguides, said third resistance means having an electrically conducting resistive film for suppressing microwave signals in at least the $TE_{21}$ and $TE_{31}$ modes.

3. The arrangement as set forth in claim 1 or claim 2 wherein said second resistance means lie approximately midway between the longitudinal axis and the circular sidewall of said circular waveguide.

4. The arrangement as set forth in claim 1 or claim 2 wherein said secondary waveguides are parallel to the electric field of the $TE_{11}$ mode signal.

5. The arrangement as set forth in claim 1 wherein said circular waveguide is connected to a rectangular waveguide by a circular-to-rectangular transition waveguide, with said mode suppressor integrally contained within said circular-to-rectangular transition waveguide.

6. The arrangement as set forth in claim 1 or claim 2 wherein said first resistance means and said second resistance means are comprised of substrates formed from a dielectric material having a top surface and a bottom surface, said substrates having contained on at least one surface thereof an electrically conducting resistive film.

7. The arrangement as set forth in claim 1 or claim 2 wherein the third resistance means contained in each said secondary waveguide are each comprised of a first resistive element having a first and a second surface and a second resistive element having a first and a second surface, each of said first and said second resistive elements having a resistive film on either said first or said second surface thereof, with the resistive film of said first resistive element in electrical contact with the resistive film of said second resistive element.

* * * * *

UNITED STATES PATENT AND TRADEMARK OFFICE

CERTIFICATE OF CORRECTION

PATENT NO. : 4,344,053

DATED : August 10, 1982

INVENTOR(S) : Tore N. Anderson

It is certified that error appears in the above—identified patent and that said Letters Patent is hereby corrected as shown below:

In Col. 4, line 51, delete "were" and substitute therefor the word --are--.

In Col. 6, line 10, delete "to" and substitute therefor the word --on--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*